US006148694A

United States Patent [19]

Spirer

[11] Patent Number: 6,148,694

[45] **Date of Patent: *Nov. 21, 2000**

[54] HAND WRENCH WITH TORQUE AUGMENTING MEANS

[76] Inventor: Steven E. Spirer, 391 Haworth Ave., Haworth, N.J. 07641

[ * ] Notice: This patent is subject to a terminal disclaimer.

[21] Appl. No.: 08/976,814

[22] Filed: Nov. 24, 1997

Related U.S. Application Data

[63] Continuation-in-part of application No. 08/965,546, Nov. 6, 1997, Pat. No. 5,953,966.

[51] Int. Cl.[7] ..... B25B 17/00; B25B 13/46; B25B 13/00

[52] U.S. Cl. ..... 81/57.3; 81/57.39; 81/58; 81/60

[58] Field of Search ..... 81/57.39, 58, 60, 81/62, 57.42, 57.3, 77

[56] References Cited

U.S. PATENT DOCUMENTS

| | | | |
|---|---|---|---|
| 1,327,991 | 1/1920 | Gatewood | 81/57.3 |
| 1,346,505 | 7/1920 | Mitchell | 81/57.3 |
| 1,522,839 | 1/1925 | Rogers . | |
| 2,204,800 | 6/1940 | Freeborn . | |
| 2,235,192 | 3/1941 | Bailey . | |
| 2,238,125 | 4/1941 | Murray . | |
| 2,292,079 | 8/1942 | Joyce . | |
| 2,296,532 | 9/1942 | Merkel, Jr. . | |
| 2,653,489 | 9/1953 | Charpentier . | |
| 2,655,015 | 10/1953 | Linder . | |
| 2,742,797 | 4/1956 | Perham . | |
| 2,783,657 | 3/1957 | Kohlhaven . | |
| 2,882,757 | 4/1959 | Fosall . | |
| 3,363,482 | 1/1968 | Case . | |
| 3,364,794 | 1/1968 | Ishoika . | |
| 3,447,404 | 6/1969 | Lachance | 81/54 |
| 3,564,953 | 2/1971 | Able | 81/57.3 |
| 3,722,325 | 3/1973 | Rogers . | |
| 4,041,835 | 8/1977 | Isler . | |
| 4,063,475 | 12/1977 | Perkins | 81/57.22 |
| 5,584,220 | 12/1996 | Darrah et al. | 81/57.29 |
| 5,732,605 | 3/1998 | Mann | 81/57.3 |

*Primary Examiner*—Timothy V. Eley
*Attorney, Agent, or Firm*—Weingram & Associates, P.C.

[57] ABSTRACT

A hand held wrench with augmenting means is provided which includes a linkage assembly to join a drive input with an output wrench socket. The linkage assembly consists of a drive link extending from the input socket and coacting with a conversion link extending to a ratchet disposed about the output socket of the device. Rotation of the drive link pivots the conversion link to transfer torque from the input to the output socket. A pawl on the driven link is provided to coact with a ratchet which encircles the output socket. A guide means is disposed in the interior of the housing of the device to coact with the linkage assembly to maintain proper alignment during a torque operation, such that stress and force are substantially reduced or dissipated, if not eliminated, during the operation. Another embodiment of the torque augmenting device is provided which includes a pair of sockets interconnected with a drive link assembly to which a pair of resilient means are operatively associated. This embodiment is well suited for use with an impact type wrench in that the torque augmenting device of the present invention automatically recycles itself for a subsequent torquing operation during the intermittent lulls of the torquing cycle of the impact type wrench.

21 Claims, 12 Drawing Sheets

HAND WRENCH WITH TORQUE AUGMENTING MEANS

CROSS-REFERENCE TO RELATED APPLICATIONS

This application is a continuation-in-part of application Ser. No. 08/965,546 filed Nov. 6, 1997 now U.S. Pat. No. 5,953,966.

BACKGROUND OF THE INVENTION

1. Field of the Invention

The present invention relates to torquing apparatus and in particular, to hand operated apparatus adapted to transmit and/or augment torque from an input through to an output of the apparatus. Additionally, the invention relates to a device which is especially adaptable for use with pulsating torque apparatus such as impact tools or other external torque providing apparatus.

2. Description of the Related Art

Wrenches are among the most useful hand tools and their design often has conflicting objects. The primary purpose of a wrench is to apply torque to a nut or other fastening device to seat or unseat the device in threaded engagement with a mating object. In order to apply large amounts of torque, wrenches normally have to be either very large in size or use auxiliary mechanisms such as hydraulic or mechanical apparatus to increase the torque provided by the wrench. This tends to make the wrench bulky and large and limit its effectiveness for normal everyday use where the object is to provide a wrench that is relatively small, can fit into tight places and is easy and convenient to use. Examples of torque augmenting devices are known and disclosed in the prior art as follows:

| U.S. Pat. No. | Inventor(s) |
|---|---|
| 1,522,839 | Rogers |
| 2,204,800 | Freeborn |
| 2,235,192 | Bailey |
| 2,238,125 | Murray |
| 2,292,079 | Joyce |
| 2,296,532 | Mekeel, Jr. |
| 2,653,489 | Charpentier |
| 2,655,015 | Linder |
| 2,742,797 | Perham |
| 2,783,657 | Kohlhagen |
| 2,882,757 | Edsall |
| 3,363,482 | Case |
| 3,364,794 | Ishoika |
| 3,722,325 | Rogers |
| 4,041,835 | Isler |

For example, U.S. Pat. No. 2,296,532 to Mekeel, Jr. discloses a torque control transmission having a reaction brake which includes a ratchet wheel and latch, and a reversing brake with oppositely facing ratchet wheel and latch. Connector arms support the latches and are pivotally operated by a lever.

U.S. Pat. No. 2,783,657 to Kohlhagen discloses a constant torque drive having a plurality of gears arranged between a pair of plates, and a pawl pivotally mounted on one of the gears and urged by a spring into operative engagement with a disc-shaped head of a stud to lock the gears against counterclockwise rotation, but permit their rotation in a clockwise direction. The gears are supported by an arm which is connected to a spring to urge the arm in a certain direction.

U.S. Pat. No. 3,364,794 to Ishoika discloses a spring torque converter having a plurality of rocking levers, pairs of which are connected with links for coaction with the drive shaft and driven shaft to apply torque. Another embodiment discloses a plurality of crank pins, and a helical spring having one end attached to the respective crank pin and another end attached to an anchoring pin on a carrier portion of the device.

The remaining patents also disclose other torquing devices.

OBJECTS AND SUMMARY OF THE INVENTION

The present invention provides a simple, efficient and light weight wrench with torque augmenting means. Disclosed is a socket wrench which utilizes a rachet arrangement commonly used in wrenches and which includes additional features within the handle of the wrench that enable an auxiliary unit to be connected to the wrench to augment the torque provided by the wrench when situations requiring high torque are encountered. The apparatus is constructed in a manner to facilitate effective coaction of the various components without placing undue stress on the housing and handle of the wrench which enables the wrench to be relatively small for the job it can perform and relatively light and easy to use.

In another embodiment of the invention, the apparatus has two power delivery sockets or driving sockets, one at either end and is relatively symmetrical. The driving sockets can be used for related sizes of nuts that would be used with the device, or for dissimilar shaped fasteners of comparable size. A central driven aperture disposed between the two power delivery sockets has opposed driving fingers extending toward either end of the device to coact with driven arms in the same manner as the single driven aperture hand wrench previously discussed. Spring means are incorporated within the housing to return a middle link, known as the MISSING LINKS™, which has opposed driving fingers to an initial position to enhance coaction between the device and an external periodic type of power delivery apparatus, such as an impact wrench.

It is an object of the present invention to provide an augmenter which can be used in confined spaces, and has an envelope sized approximately the same as a standard wrench socket to fit in an area between adjacent nuts.

It is another object of the present invention to provide a hand wrench augmenter which can operate as a hand wrench or as a plain wrench without any force augmentation.

It is another object of the present invention to provide a hand wrench having means to enable additional torque to be transmitted to the hand wrench, which in turn is converted to torque at the wrench engaging portion of the apparatus to augment the total torque that can be exerted by the wrench.

It is another object to the present invention to provide a hand wrench with torque augmenting means which can function either as a hand wrench or as a high torque tightening apparatus of limited travel independently of each other.

It is another object of the present invention to provide a hand wrench augmenter which can be augmented in multiple positions and from either side.

It is an object of the present invention to provide a hand wrench which is adapted for use with a separate input drive to transmit torque to an output drive such as a socket.

It is another object of the present invention to provide a hand wrench which is of simple construction, easy to maintain and repair, and adapted to receive differently sized input drives to transmit torque to the output drive.

It is another object of the present invention to provide a hand wrench constructed with linkage to transmit and convert the torque at the input receptacle to the output drive.

It is another object of the present invention to provide a hand wrench which is operable without external gears or hydraulics.

It is another object of the present invention to provide a hand wrench constructed with a housing in which a guide means is disposed to substantially reduce, if not eliminate, forces at an interior portion of the housing and the linkage within the housing, such that the structural integrity of the housing is maintained.

It is another object of the present invention to provide a hand wrench constructed with a housing having side walls arranged to absorb the force of the internal linkage during an operation of the apparatus.

It is another object of the present invention to provide a hand wrench having a housing in which a biasing means is arranged to automatically urge the linkage to reset for a subsequent torque transmission/augmenting operation.

It is another object of the present invention to provide a hand wrench having a pair of sockets of different sizes at opposed ends of the hand wrench.

It is another object of the present invention to provide a hand wrench adapted to coact with the drive member of an external torquing member such as an impact wrench.

It is another object of the present invention to provide a wrench with a linkage assembly constructed and arranged to interconnect a pair of drive socket assemblies for coaction therewith during a torquing operation.

It is another object of the present invention to provide a wrench with a housing sealed for containing lubricating means therein for elements of the wrench.

It is another object of the present invention to provide a wrench containing linkage means adapted to coact with a repetitive external torque source, to enable coaction between the internal linkage of the wrench and the external pulsating impact torque source.

It is another object of the present invention to provide a wrench with an internal linkage assembly adapted for use with compression springs or leaf springs to initialize the wrench during repetitive cycles.

It is another object of the present invention to provide a wrench with an augmenting means constructed and arranged within a housing of the wrench to automatically reset for a torque augmenting cycle during a lull in operation of a coacting impact wrench.

It is another object of the present invention to provide a wrench having a torque augmenting means adapted to coact with an intermittent cycle of an impact wrench.

It is another object of the present invention to provide a wrench adapted to coact with an external source of cyclic torque.

It is another object of the present invention to provide a wrench which is relatively lightweight, relatively durable, and of simplified construction.

It is another object of the present invention to provide a wrench constructed to minimize the size of the driving sockets of the apparatus to enable the apparatus to be positioned in areas not easily accessible by an external pulsating torque source.

It is another object of the present invention to provide a wrench relatively inexpensive to fabricate, and which can be produced in a wide range of sizes to fit fasteners of relatively small sizes up to relatively large sizes exceeding 6" in diameter.

BRIEF DESCRIPTION OF THE DRAWINGS

For a more complete understanding of the present invention, reference may be had to the following detailed description of preferred embodiments taken in conjunction with the accompanying drawings, of which.

DETAILED DESCRIPTION OF THE PREFERRED EMBODIMENTS

Figure 1:
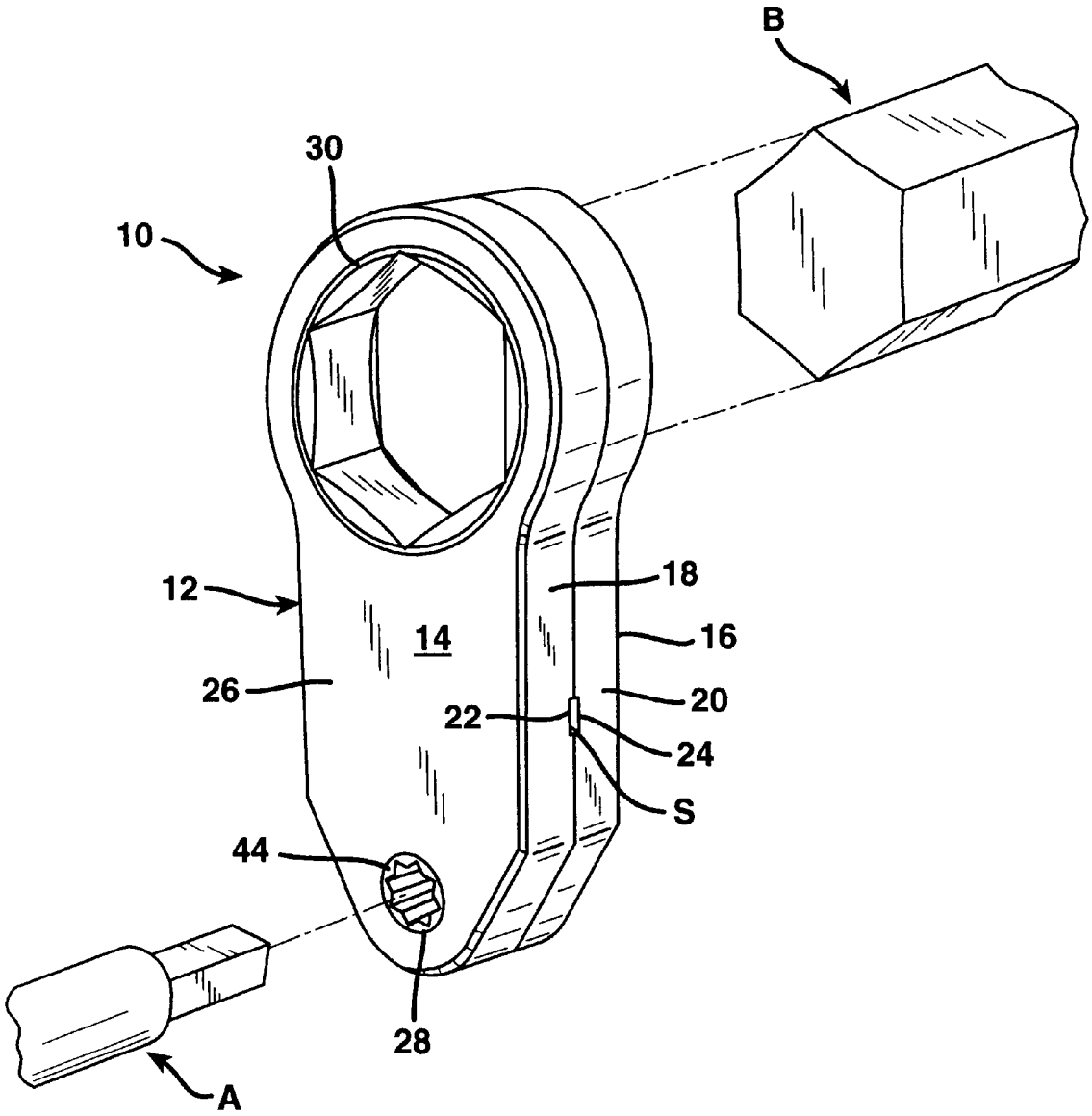
FIG. 1 is a perspective view showing a hand wrench with torque augmenting means according to the present invention.
Figure 2:
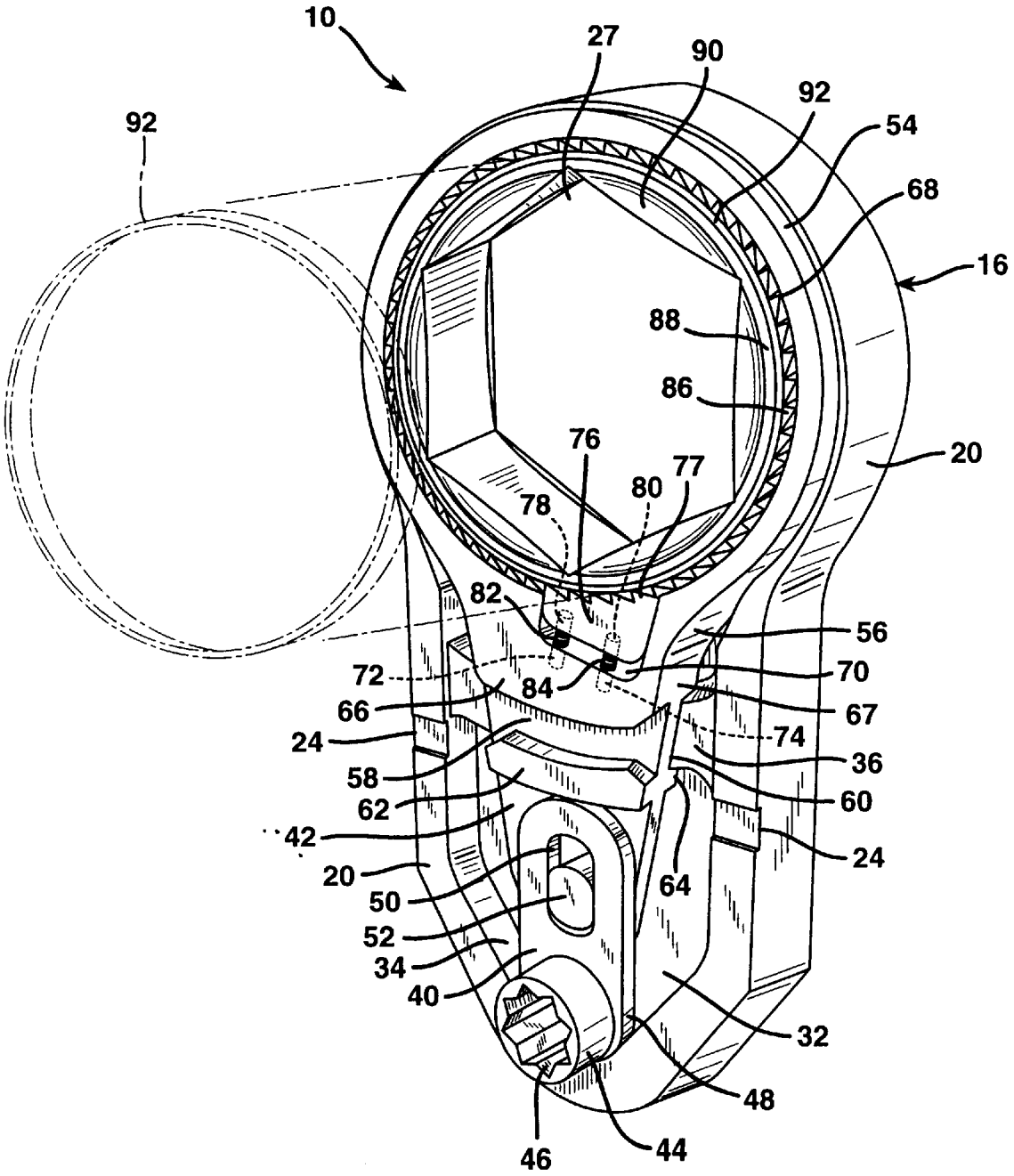
FIG. 2 is a top perspective view showing internal elements of the hand wrench.

Referring to FIGS. 1 and 2, a hand wrench having torque augmenting means of the present invention is shown generally at 10. The augmenter 10 is constructed to receive an external drive input A and transmit or augment the torque from the input A to an output B, such as a hex-sided stud or bolt.

The augmenter 10 consists of a housing 12 which is constructed from a pair of halves 14,16. The halves 14,16 can be held together by conventional mechanical fasteners such as screws, or with a friction fit. Each one of the halves 14,16 is provided with a continuous side wall 18,20 in which a corresponding detent or cutout 22,24 is formed. When the halves 14,16 are brought together to form the housing 12, the cutouts 22,24 formed in the respective side walls 18,20 are aligned in registration with each other to provide a space S at which force can be exerted to part the halves 14,16.

The half 14 has an exterior surface 26 upon which printed indicia can be displayed. The indicia can be instructions for operating the tool, logos, safety notices, etc. The half 16 has an exterior surface also for printed indicia which is not shown due to the perspective of the drawing Figures.

The half 14 is constructed with a small aperture 28 at one end thereof, the aperture 28 extending from the surface 26 completely through the half 14. An opposite end of the half 14 is formed with a larger aperture 30 which similarly extends from the surface 26 completely through the half 14.

Figure 3:
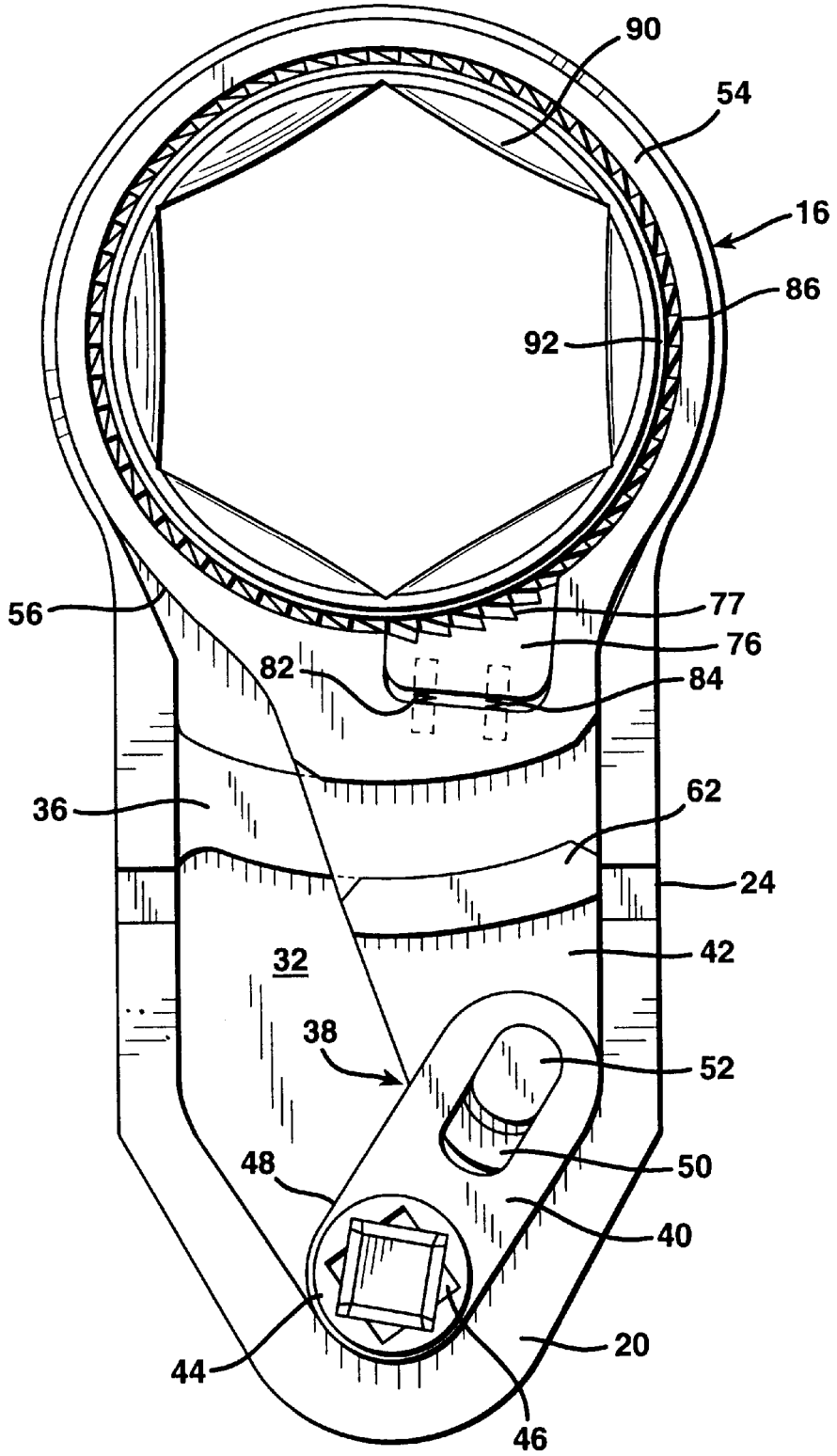
FIG. 3 is a top plan view showing the hand wrench at rest for a torque operation.

Referring also to FIGS. 2 and 3, additional elements of the augmenter 10 are also disclosed.

The half 16 includes an interior floor 32 from which the continuous side wall 20 extends upward therefrom. The side wall 20 is provided with an inner surface 34. An arcuate guide bar 36 extends upward from the floor 32. The guide bar 36 extends across the floor 32 such that each one of the opposed ends of the guide bar 36 is connected to a corresponding portion of the inner surface 34 of the continuous side wall 20 at opposite sides of the floor 32.

In FIG. 3, the augmenter 10 of the present invention is shown at rest ready to commence a torque operation. The elements of the augmenter 10 which enable the transmission and augmenting of torque are as follows.

A linkage assembly shown generally at 38 is constructed and arranged for operation when the halves 14,16 are joined together. The linkage assembly 38 includes a drive finger 40 and a driven arm 42.

The drive finger 40 has a first end from which an upstanding cylindrical portion 44 extends. The cylindrical portion 44 extends through both halves 14,16 when joined together. The drive finger 40 rotates about the cylindrical portion 44. The cylindrical portion 44 is provided with a hex or other multi-sided aperture 46 (FIG. 2) extending completely therethrough. The aperture 46 is adapted to act as an engaging receptacle for a multi-sided male drive member A. The aperture 46 is constructed and arranged in the drive finger 40 to be in registration with the aperture 28 of the half 14. The half 16 is similarly provided with an aperture which is in registration with the aperture 28 of the half 14, such that when the halves 14,16 are joined to each other with the linkage assembly 38 disposed therebetween, the multi-sided aperture 46 of the drive plate 40 is accessible at the smaller aperture 28 of the half 14 or at the corresponding aperture (not shown) in the other half 16. This permits the user to extend the drive input A completely through the housing 12, or to enable access to the engaging receptacle from either side of the housing. Therefore, the receptacle will always be accessible even if necessary to turn the augmenter 10 over for an operation.

The drive finger 40 is constructed with a side wall generally shown at 48 which substantially conforms to the tapered shape of the inner surface 34 of the side wall 20 of the half 16. As shown in FIG. 3, an arcuate portion of the side wall 48 is constructed to rest against and be received by the complimentary tapered inner surface 34. This permits the drive finger 40 to pivot in position and rest against the side wall 20. However, as will be discussed hereinafter, the drive finger 40 does not exert a pressure load against the side wall 20 which would be sufficient to weaken the side wall 20.

The opposite, free end of the drive finger 40 is formed with an oblong-shaped aperture 50 extending completely therethrough. A longitudinal axis of the oblong-shaped aperture 50 bisects a central axis of the multi-sided aperture 46.

The driven arm 42 includes at one end a pin 52 extending therefrom. The pin 52 is constructed and arranged to be in registration with and received by the oblong-shaped aperture 50 of the drive finger 40. The pin 52 is similarly oblong-shaped and is of a height that preferably is at least equal to the depth of the oblong-shaped aperture 50, and does not exceed the greatest height of the driven arm 42. The pin 52 is rotatably mounted to the driven arm 42. Alternatively, the pin 52 may be circularly shaped and fixed to the driven arm 42.

The driven arm 42 widens as it extends to assume a circular shape. As also shown in the perspective view of FIG. 2, a larger, circular shaped portion of the driven arm 42 is shown generally at 54.

The driven arm 42 is provided with side walls 56 and 57 which are shaped to engage along their entire length or to engage substantially along their entire length the inner surface of the continuous wall 20 of the housing when the driven arm is at the end of its travel. This tends to distribute the forces produced by the side wall of the driven arm 42 along the entire housing, minimizing the stress at any one point.

The shape of the side wall 56 permits the driven arm 42 to pivot freely within the half 16 when the driven arm 42 coacts with the drive finger 40.

An arcuate boss 62 or ridge extends upward from the driven arm 42 to coact with the drive finger 40. The height of the boss 62 substantially corresponds to the thickness of the drive finger 40 for a purpose to be described with reference to FIGS. 4 and 5.

Grooves 58 and 60 respectively are machined in the driven arm leaving ridges 62 and 66, and 64 and 67 respectively. The grooves 58, 60 are adapted to mate with a pair of arcuate ridges. The arcuate ridge on the floor of the top plate is not shown. The arcuate ridge on the bottom half being designated as 36. The coaction of the grooves 60 on the driven arm with the arcuate ridge 36 on the back half of the housing provides a guide for movement of the driven arm and also provides for structural support of the driven arm as it is moved by the drive finger. The top of the ridges 62 and 66 and the front side, and the ridges 64 and 67 on the rear extend to the inner surface of the housing when halves 14, 16 are assembled.

As shown more particularly in FIG. 2, the arcuate guide bar 36 is sized and shaped to be received in the groove 60, while another arcuate guide bar (not shown due to the perspective view of the Figures) of half 14 is received in the groove 58. This construction permits the driven arm 42 to ride along the arcuate guide bar 36 and the prescribed angle of arc of the guide bar 36.

The driven arm 42 widens generally at 66 into a circular portion having an aperture 68 extending completely therethrough and in registration with the large aperture 30 of the plate 14 and the aperture 27 of the plate 16. The circular portion 66 of the driven arm 42 is formed with a recess 70 in communication with the aperture 68. A pair of bores 72,74 are formed in the circular portion 66 of the driven arm 42 and open into the recess 70.

A pawl 76 is disposed in the recess 70. The pawl 76 is formed with a pair of bores 78,80, each of which is in registration with a corresponding one of the bores 72,74 of the driven arm 42. Springs 82,84 are disposed in the recess 70, each one having its opposed ends terminating in a corresponding one of the bores 72,78 and 74,80, respectively. The springs 82,84 resiliently bias the pawl 76 to float in the recess 70 so that inclined teeth 77 of the pawl 76 are urged to engage corresponding inclined teeth 86 of a ratchet 88 disposed in the large aperture 30.

The ratchet 88 fits in a stepped portion of the aperture 68. The aperture 68 has a larger diameter and a smaller diameter. The larger diameter will accommodate the teeth of the rachet and the small diameter will support the teeth and enclose the entire ratchet mechanism.

The ratchet 88 is circular in shape and is received in the large circular end 54 of the driven plate 42 to surround a hex socket 90. The ratchet 88 is connected to and preferably an integral part of the hex socket 90.

A circular shaped wear collar 92 is constructed and arranged to extend around the hex socket 90 above the ratchet teeth 86. The wear collar 92 is made from bronze or other soft alloy to reduce friction during a torque operation when the halves 14,16 are joined to form the housing 12.

The starting position of the torquing operation is shown for example in FIGS. 1 and 3. First, the housing 12 of the augmenter 10 is grasped and the large hex will be engaged with the item to be tightened such as the output shaft B. The handle of the wrench 12 is then manually turned much as a standard socket head wrench until the output shaft is tight and further movement of the handle manually is no longer possible. If augmented torque is required, then an augmenting drive shaft A is entered into the augmenting receptacle aperture 46. The input shaft A can then be rotated. This can either be a long lever, or it can be a power type of unit. However, even a 12 inch additional lever rotating the augmenting receptacle will be sufficient to produce substantial augmenting torque since the lever can be substantially longer than the length of the handle. Additionally, since the handle must be located in a fixed position in a specific location with respect to the output shaft to be tightened, there may not be sufficient room to obtain proper purchase for rotating the handle of the augmenter, whereas an auxiliary lever or rotating bar can extend to an area of greater freedom when using the augmenting feature.

Figure 4:
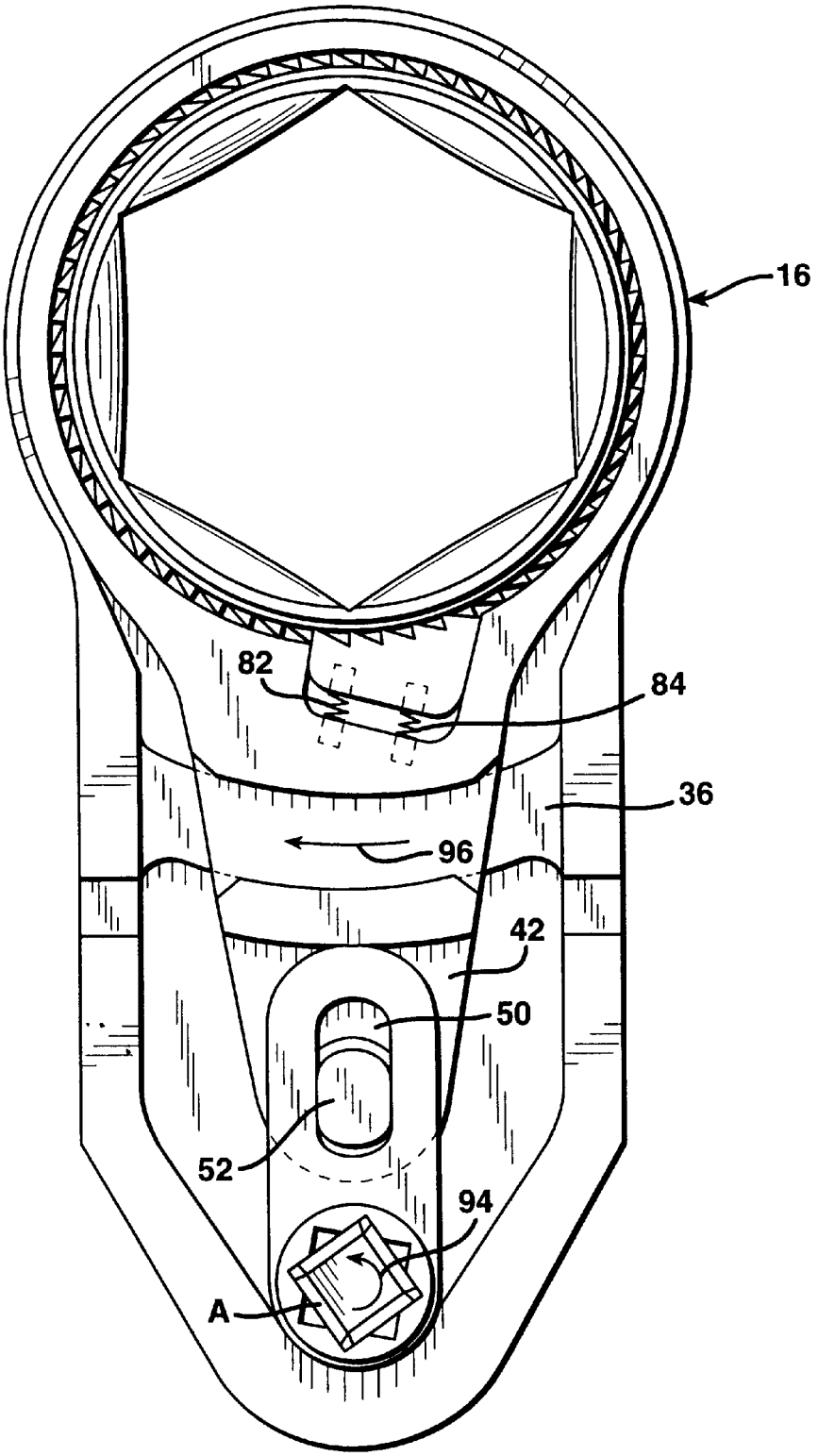
FIG. 4 is a top plan view of elements shown in the view of FIG. 3 coacting for a torque conversion stroke.

The input A is turned as indicated by the arrow 94 shown in FIG. 4. The rotation is in, for example, a counter clockwise direction. Accordingly, the drive finger 40 is also urged to pivot in a counter clockwise direction. The driven arm 42 is urged to move in a direction of arrow 96, while the pin 52 moves along the oblong-shaped aperture 50 of the drive finger 40.

The arcuate guide bar 36 extending upward from the bottom 32 of the plate 16 provides a stress point for the drive finger 40 and the driven arm 42. That is, as the finger and arm 40,42 respectively, are pivoted, there is a tendency for the finger 40 and arm 42 to be forced away from each other which would, but for presence of the guide bar 36, cause a detrimental amount of force to be incurred by the continuous side wall 20 of the plate 16. The guide bar 36 restricts the "parting" of the linkage assembly 38 and channels the stress and forces which occur during the torque operation to a more central location of the plate 16. Such forces are disbursed so that the structural integrity of the halves 14,16, and therefore the housing 12, is not compromised.

Figure 5:
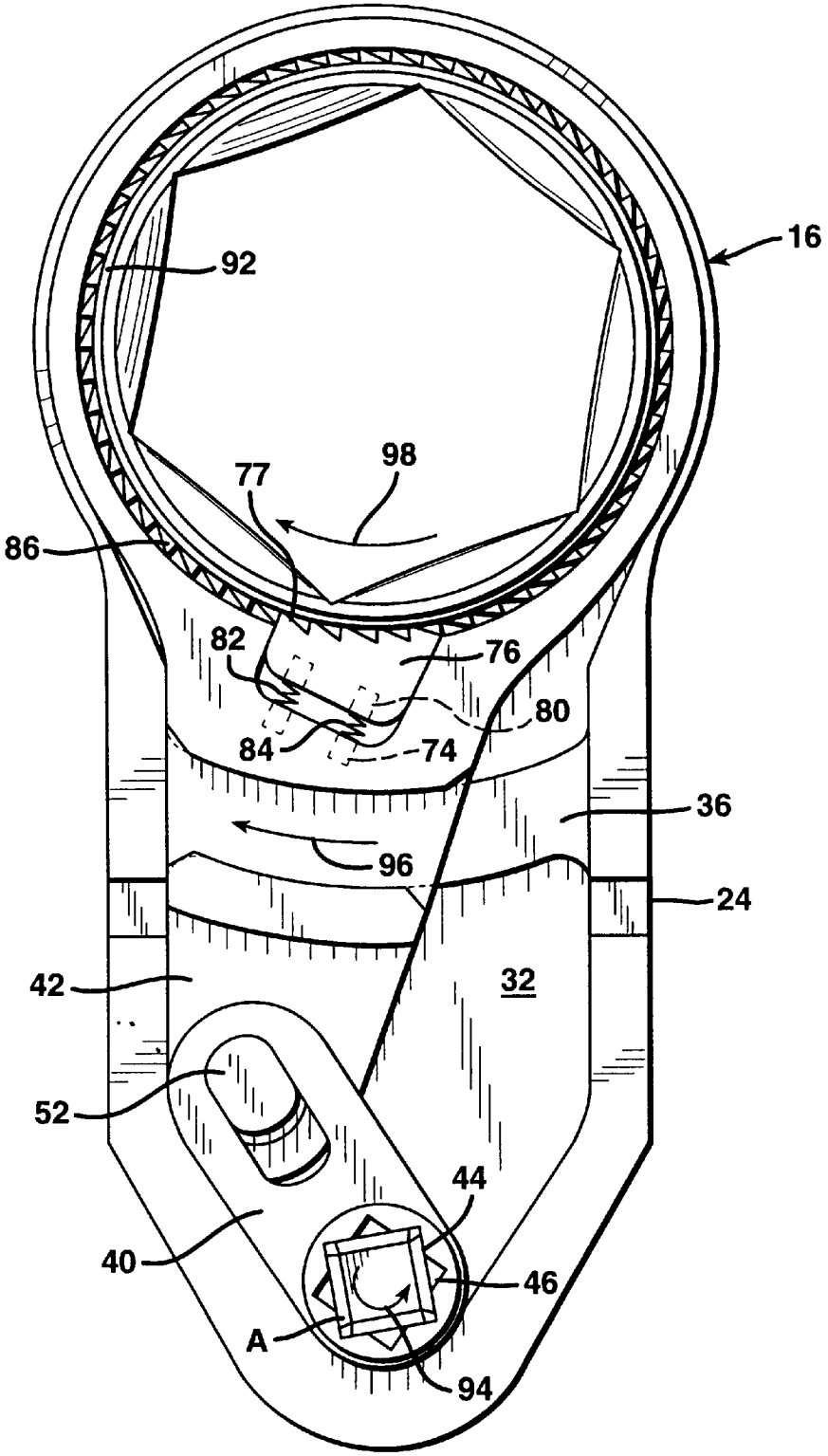
FIG. 5 is a top plan view of the hand wrench of FIG. 4 completing the stroke.

As the linkage assembly 38 is pivoted, the inclined teeth 77 of the pawl 76 engage the corresponding inclined teeth 86 of the ratchet 88. This motion forces the hex socket 90 to pivot as indicated by arrow 98 in FIG. 5 to tighten down the bolt B. The springs 82,84 as shown in FIGS. 4–5, bias the pawl 76 toward the ratchet 88 for engagement of the teeth 77,86. The motion of the linkage assembly 38 is therefore imported to the hex socket 90 to allow effective motion only in the direction as indicated by the arrow 98.

When the "throw" of the linkage assembly 38 is complete, as shown in FIG. 5, the input A is moved in the opposite direction, i.e. clockwise, to return the linkage assembly 38 for another torque operation. This movement permits the inclined teeth 77 of the pawl 76 to ride over the inclined teeth 86 of the ratchet so that the mechanism can be reset as in FIG. 3 for another torque cycle.

Figure 6:
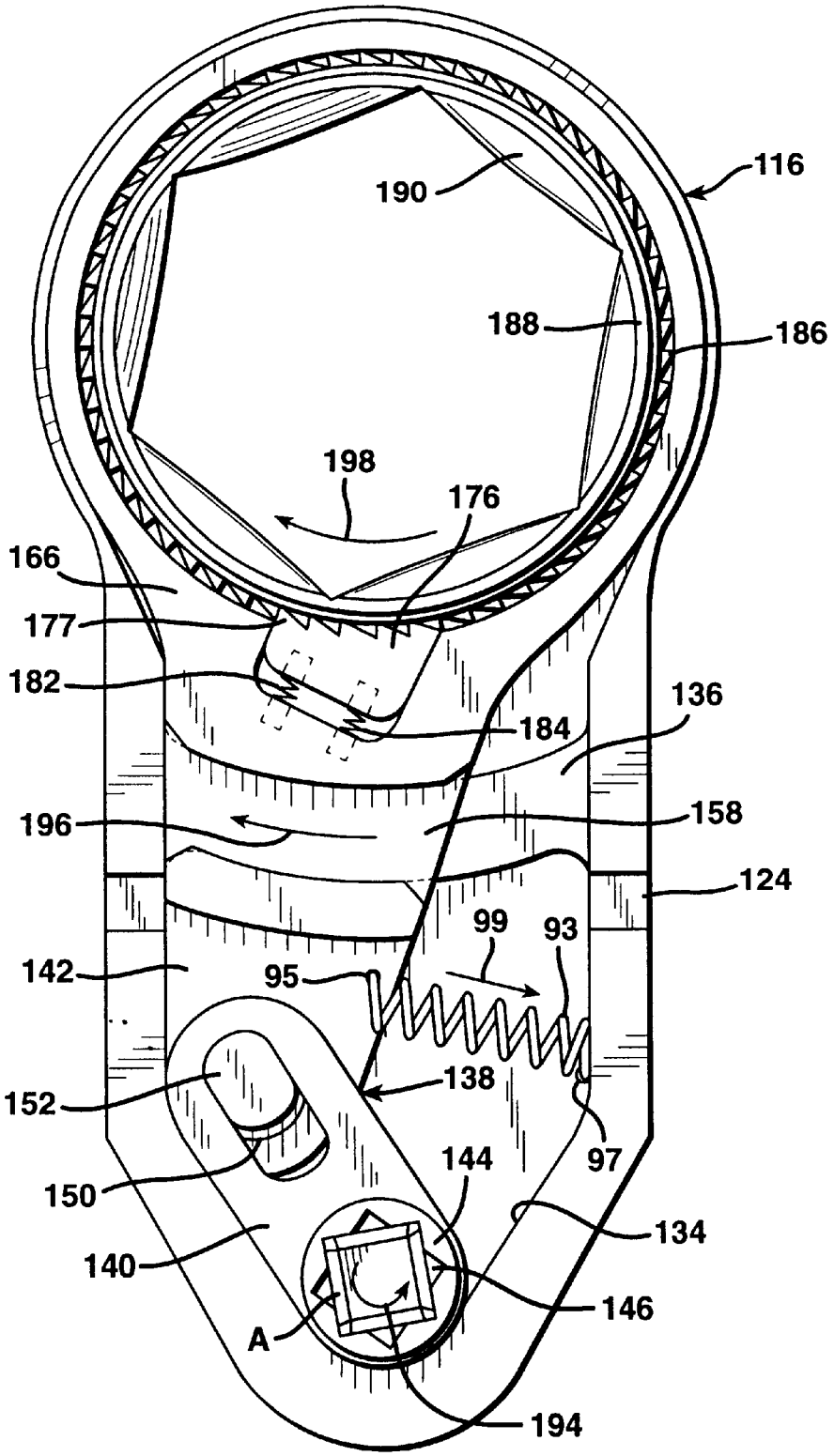
FIG. 6 is a top plan view showing elements of another embodiment of the hand wrench according to the present invention.

Another embodiment of an augmenter 110 constructed in accordance with the present invention is illustrated at FIG. 6. Elements illustrated in FIG. 6 which correspond to elements described above with respect to FIGS. 1–5 have been designated by corresponding reference numerals increased by 100. The embodiment of FIG. 6 is designed for use in a manner similar to that shown with respect to the embodiment of FIGS. 1–5, unless otherwise stated.

Referring now to FIG. 6, an additional biasing element 93 is shown. The biasing element 93 can be an extension spring, as shown in FIG. 6, or a torsion spring. In the example shown, the extension spring 93 has one end 95 connected to the driven arm 142, and an opposite end 97 connected to the continuous side wall 120 of the plate 116. The spring 93 inherently biases the linkage assembly 138 in a direction of arrow 99 to facilitate the return of the linkage assembly 138 to the starting position after the "throw" of the linkage assembly 138 is complete.

The construction and coaction of the drive finger 140 and the driven arm 142 of the linkage assembly 138 is such that a pair of springs 93 can be employed. That is, in addition to the spring 93, another spring (not shown), or a plurality of springs can be attached to the driven arm 142 at an opposite side to which the spring 93 is attached, and then to a corresponding portion of the side wall 120 to facilitate movement of the linkage assembly 138 in either direction.

The augmenter 110 is not limited to having only an extension spring such as that shown in FIG. 6. The device can be constructed with a combination of extension springs and torsion springs to operate as the biasing element 93.

It is preferred to mount the biasing element 93 as shown, as this position is proximate to the region of pivotal coaction between the drive finger 140 and the driven arm 142, thereby most effectively using the biasing force of the spring 93.

Figure 7:
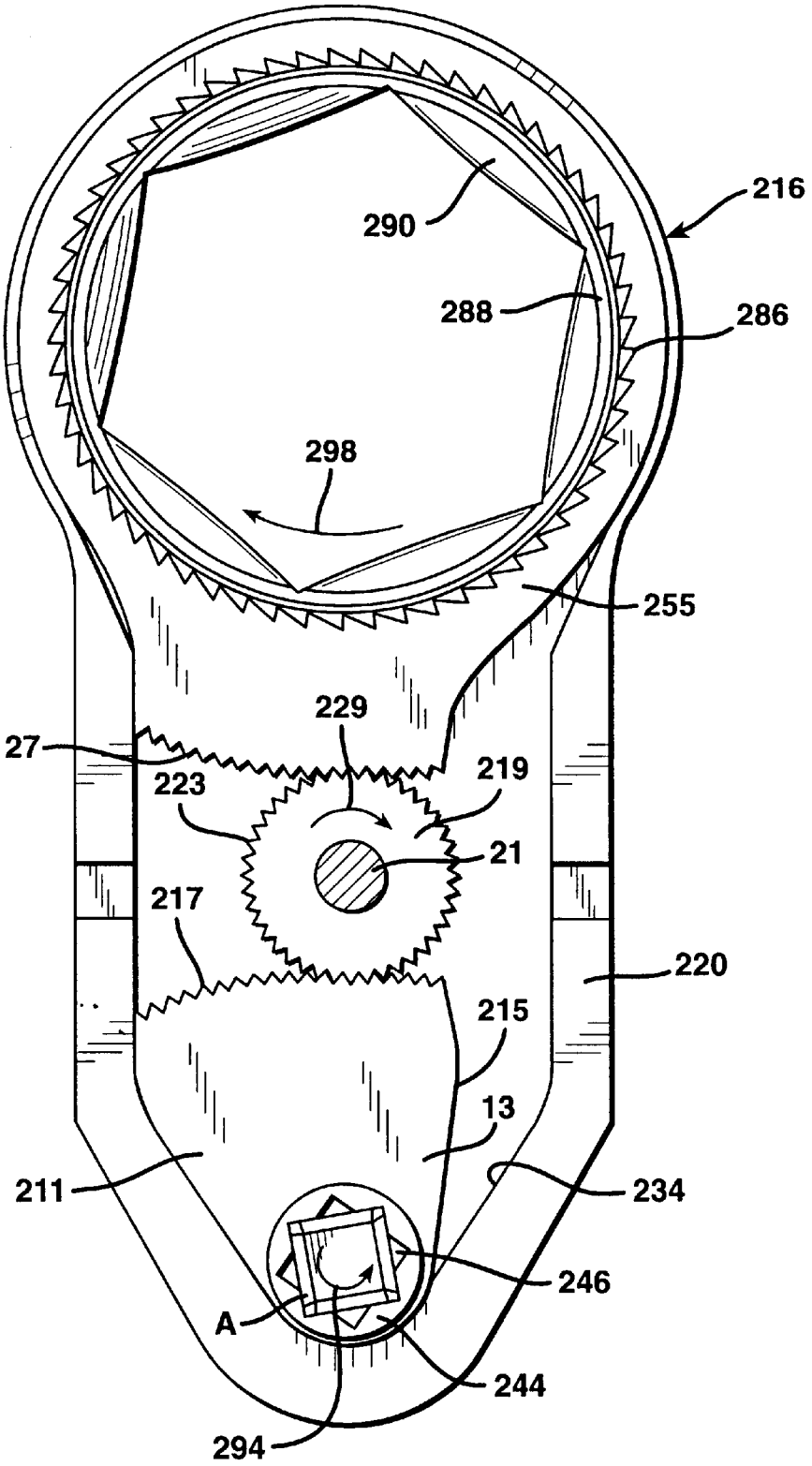
FIG. 7 is a top plan view showing elements of still another embodiment of the hand wrench according to the present invention.

Another embodiment of an augmenter 210 constructed in accordance with the present invention is illustrated at FIG. 7. Elements illustrated in FIG. 7. which correspond to elements described above with respect FIGS. 1–5 have been designated by corresponding reference numerals increased by 200. The embodiment of FIG. 7 is designed for use in a manner similar to that shown with respect to the embodiment of FIGS. 1–5, unless otherwise stated.

In FIG. 7, a drive finger 211 has a first end from which a cylindrical portion 244 extends. The cylindrical portion 244 is provided with a hex or other multi-sided aperture extending completely therethrough. The half 216 is similarly provided with an aperture which is in registration with the aperture 246 of the half 214, such that when the halves 214, 216 are mated, the multi-sided aperture 246 of the drive finger 211 is accessible from an exterior of the half 214. This permits the user to extend the drive input A completely through the housing regardless of the length of the input A. The drive finger 211 is constructed with a side wall generally shown at 13 which substantially conforms to the shape of the upstanding side wall 220 of the half 216.

As shown in FIG. 7, a side wall 215 of the drive finger 211 is constructed to rest against the complimentary shaped side wall 220 extending from the half 216. This permits the drive finger 211 to pivot in position and rest against an inner surface 234 of the side wall 220.

An opposite end of the drive finger 211 is formed with a rack of teeth shown generally at 217. The rack 217 extends completely along this end of the drive finger 211 and is of a particular thickness and pitch for coaction with other elements of this embodiment as discussed below.

A transfer gear 219 is disposed for pivotal movement between the halves 214, 216. The transfer gear 219 is mounted to the half 216 by a pin 21. A plurality of teeth 223 extend along a peripheral edge of the gear 219, which teeth 223 are constructed and arranged for releasable mating engagement and contact between corresponding teeth 217 on the drive finger 211. During a torque operation, at least three or four, and preferably five of the teeth 217,223 on the drive finger 211 and the transfer gear 219, respectively, are in contact to provide strength and stability during the torque operation.

The driven arm 225 in FIG. 7 is provided with a rack of teeth 27 extending along a peripheral edge of a portion thereof. The pitch of the teeth on the rack 27 of the driven arm 225 is equal to the pitch on the teeth 217 on the driven arm 211. The rack of teeth 27 is of a thickness and pitch to facilitate releasable mating contact with the teeth 223 of the transfer gear 219. At least three or four, and preferably five teeth of the transfer gear 219 and driven arm 225 mesh during a torque operation to facilitate strength and stability of the device during the operation.

Springs (not shown) can also be used with the embodiment of FIG. 7 to bias the drive finger 211 and driven arm 225 to their selective positions.

The embodiment of FIG. 7 operates as follows.

The drive input A is inserted into the aperture 246 and turned in the direction of arrow 294. The drive finger 211 is moved in a counter-clockwise direction with the teeth 217 thereof in engagement with the teeth 223 of the transfer gear 219. The transfer gear 219 in turn rotates in a clockwise direction as shown by the arrow 229. This motion of the transfer gear 219 causes the conversion plate 225 to move in a clockwise direction as indicated by the arrow 298 to impart a rotational movement to the teeth 286 of the ratchet 288. The hex socket 290 is also moved in a clockwise direction to turn the bolt or stud being tensioned. When the hex socket 290 has been turned down on the bolt or stud through a complete "throw" of the turning operation, the device is returned by the user in an opposite direction for the conversion plate to ride over the teeth 286 to prepare for a subsequent torquing operation during which the teeth 286 of the ratchet 288 are engaged to subsequently cause the hex socket 290 to tighten down the bolt.

The height of drive finger 211 and driven arm 225, in combination with locking means (not shown) for the housing function as a guide for 211,225.

The construction of the teeth used for the drive plate 211, transfer gear 219 and driven arm 225, are selected for gear backlash to be within tolerable limits so that slippage is reduced as much as possible upon reversal of the gear rotation.

As shown in FIGS. 1–5, the wrench with augmenting device can be used as a simple hand wrench tool to either tighten or loosen nuts to another fastener. The socket of the wrench is fitted over the item to be loosened or tightened in the same manner that a ratchet type socket wrench would be fitted over any standard item to be wrenched. Note that nesting sockets (not shown but well known in the art) could be used to modify the size of the engaging socket in order to give the tool a wider range of operative use. The tool also has a relatively narrow rim between the socket and the outer edge of the tool surrounding the socket. This enables the tool to be placed into relatively narrow areas which is often the case with bolting circles and other areas which provide limited access for the worker. The tool is then operated as a standard ratchet socket wrench. The handle is rotated about the socket to loosen or tighten the item that is to be wrenched. In an instance where a high torque is necessary; either to "break" or dislodge a nut or other fastener which tends to become frozen in place, or to "snug up" the item to be tightened when it is no longer possible to easily move the handle of the wrench, then the augmenting feature of the wrench is employed. A mating drive fits into the drive socket or receptacle in the bottom of the handle. This drive implement can be a relatively long bar or it can be connected to the output drive of a mechanical or pneumatic device. The auxiliary drive member is then actuated to rotate the driven socket in the handle, which actuates the linkage in the handle of the wrench to rotate the socket through a limited angle as discussed. This limited angle will be sufficient to tighten or loosen the item that is being acted upon by the wrench. If it turns out that the linkage in the handle of the wrench has "stopped out" or run its full travel without reaching the desired level of torque being applied by the actuating socket of the wrench then the auxiliary torque apparatus can be reversed. The rachet feature of the wrench, will allow the linkage within the handle to return to the initial position. The auxiliary torque apparatus does not have to be removed from the drive socket at the bottom of the handle, but merely rotated in a direction opposite to the force applying direction because the ratchet feature will allow the linkage within the handle to return to its initial position.

The wrench of course can be used to tighten or loosen, merely by turning the wrench over, and using one face for turning in a clockwise direction and the other face for turning in a counter clock-wise direction. As shown in FIGS. 2–5, the front and back halves of the housing have ridges which coact with and guide the grooves in the driven arm of the linkage over a relatively wide area. Additionally, the sides of the driven arm are shaped to conform with or abut the interior side walls of the linkage along a long length of the driven arm. This will tend to dissipate the force that will be applied to the housing by the linkage when the linkage is "stopped out" at the end of its travel. Similarly, the pin arrangement and slotted drive finger allow for relatively wide contact surfaces to minimize wear. The ridges or raised portions on the driven arm which surround the rachet at the lower end which form the groove for the ridges from the housing act as a stiffening member when the halves are assembled to provide strength for the handle making the tool relatively rugged but still operable.

The ratchet and socket arrangement is relatively simple and reliable, and the wear features of the construction insure not only that the life of the tool will be relatively long, but its operation will be relatively easy.

Shown in FIG. 6 are a variety of springs which can also be used to bias the driven arm of the apparatus. The springs can be compression springs or torsion springs.

As shown in FIG. 7, the apparatus can also be built in a variety of ways such as by use of an idler gear between two gear racks, which replaces the linkage.

Figure 8:
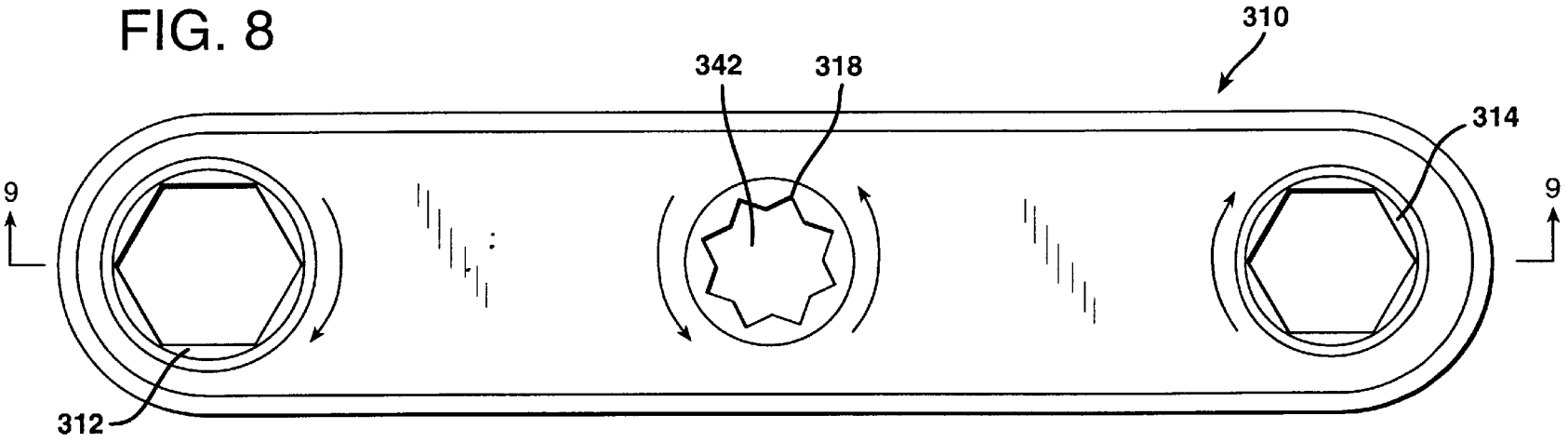
FIG. 8 is a top view of another embodiment of the invention having driven apertures on each end of the device and being relatively symmetrical in nature, with a drive aperture centrally located.
Figure 9:
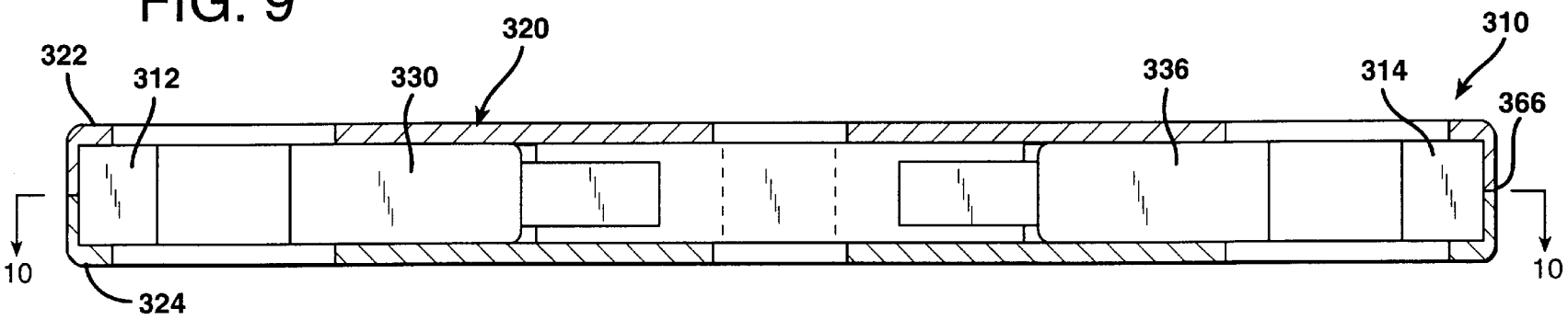
FIG. 9 is a side view taken along line 9—9 of FIG. 8.
Figure 10:
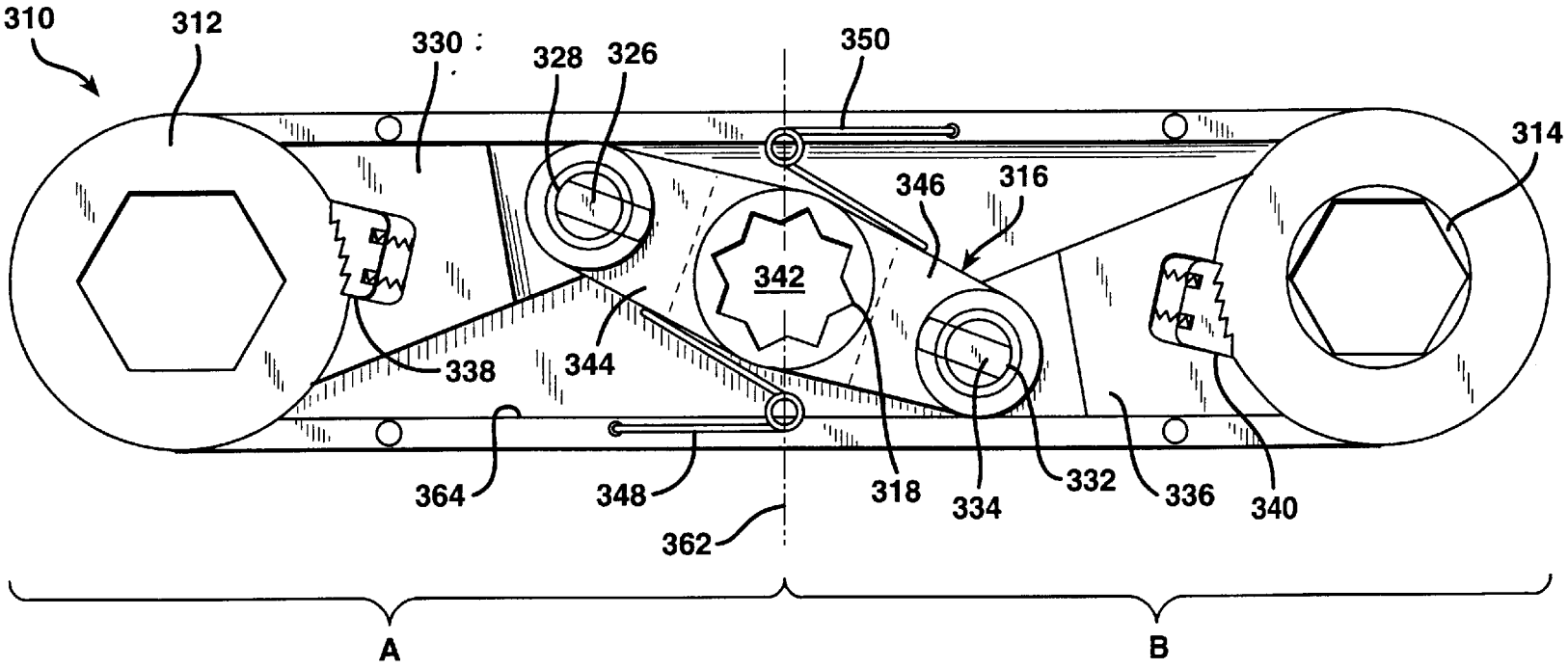
FIG. 10 is a view taken along line 10—10 of FIG. 9.

Referring to FIGS. 8–10, there is shown another embodiment of the invention at 310 having a symmetrical arrangement in which a pair of drive sockets 312,314 are provided, each driven from a link 316 connected to the driven middle socket 318. The drive sockets 312,314 and link 316, as well as other elements of this embodiment discussed below, are disposed in a housing 320 for the augmentor 310 consisting of releasably engagable halves 322,324. The same form of linkage shown in FIGS. 2–6 is present in the augmentor 310, with the oval pin 326 rising in slot 328 in the driven arm 330 of region A, and oval pin 332 rising in slot 334 from the driven arm 336 in region B. A similarly constructed ratchet and pawl arrangement 338,340 is used with respect to each of the drive sockets 312,314 at each end of the wrench. Driving the driven aperture 342 of the socket 318 will cause rotation of the link 316 with the opposing drive arms 330,336. The drive fingers 344,346 rotate the driven arms 330,336 to rotate the adjacent ratchet assemblies 338,340 until the driven arms 330,336 abut a respective opposed side of the housing 320 along the length of the arms 330,336.

The driven or middle link 316 has torsion springs 348,350 on either side attached to the adjacent wall of the housing. The springs 348,350 each slide as the middle link is rotated, and tend to urge the middle link 316 into the initial position as shown in the drawing.

Figure 11:
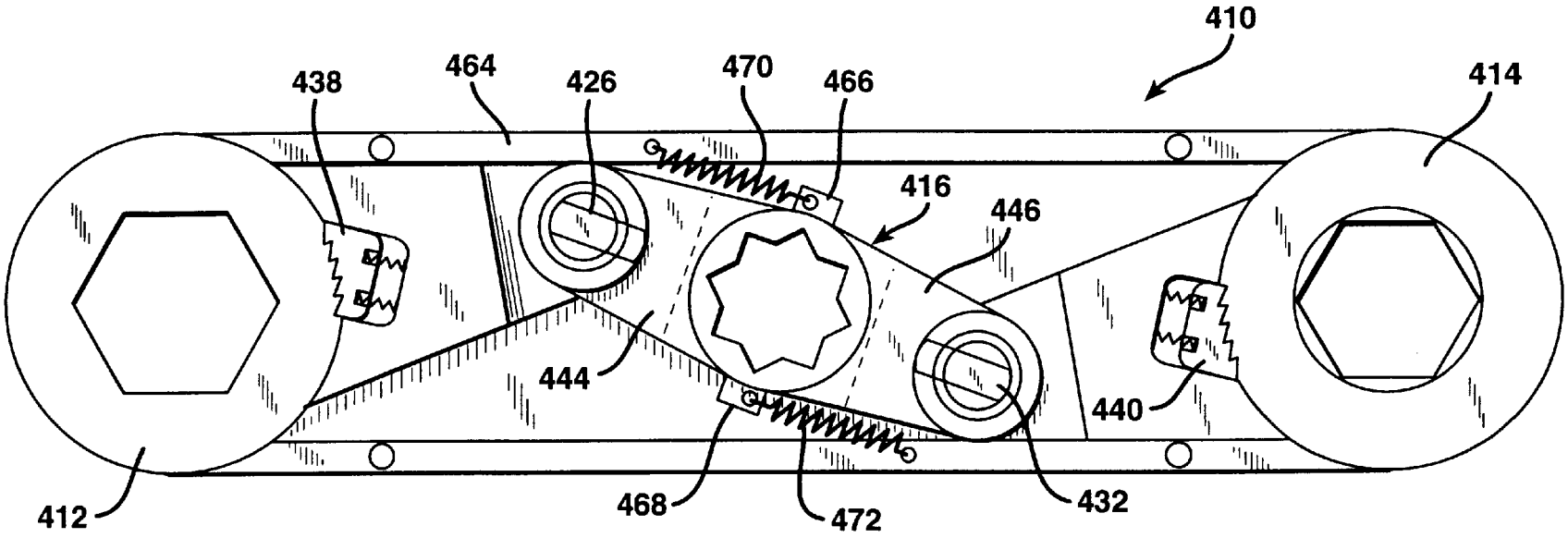
FIG. 11 is another embodiment of the invention similar to the view shown in FIG. 10.
Figure 13:
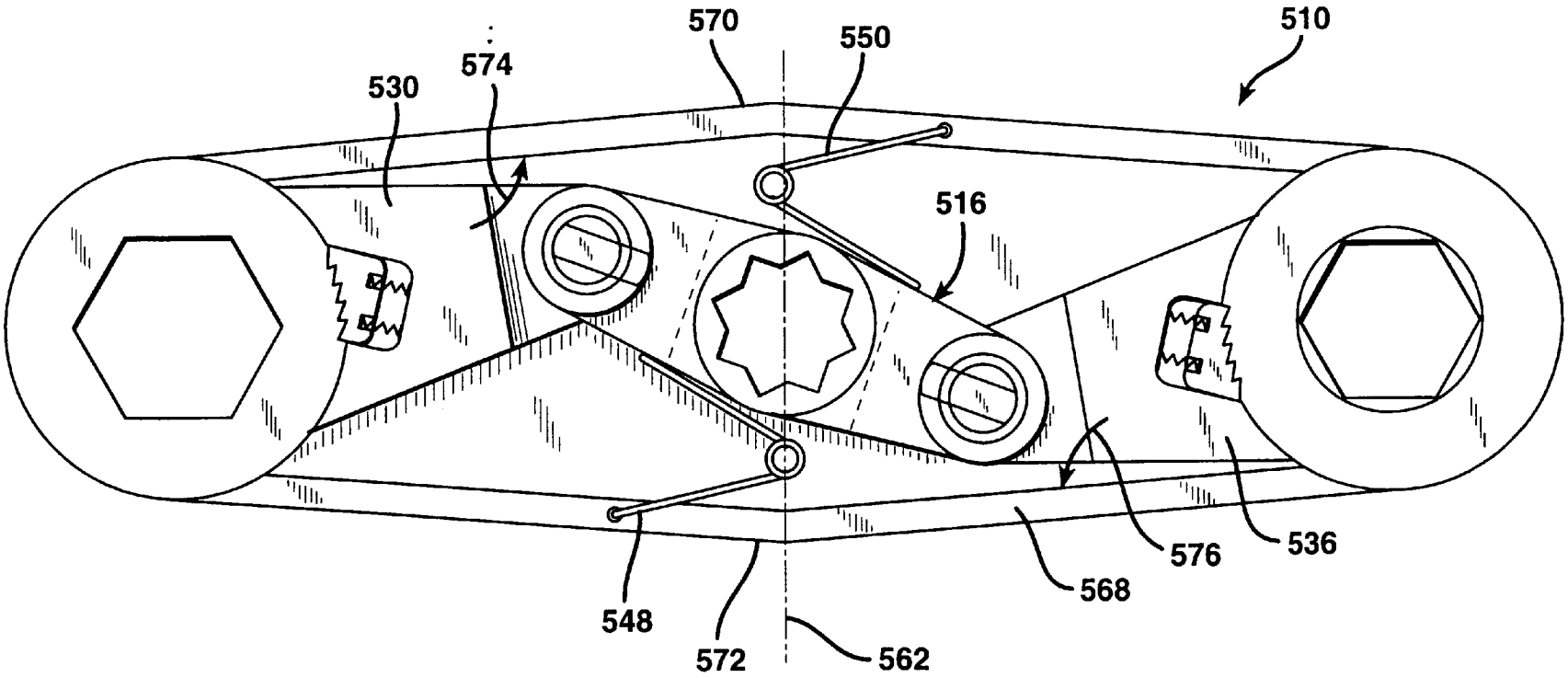
FIG. 13 is a view of another embodiment of the present invention similar to the view shown in FIG. 10.

The various guides, slots and grooves that are shown in FIGS. 1–7 on the front and back walls of the housing, and on the driven arms of the apparatus can also be included in the structure of the embodiment shown in FIGS. 8–10, and the embodiment shown in FIGS. 11 and 13.

While the augmentor 310 is shown having parallel sides and is relatively symmetrical, these dimensions will vary depending upon the size of the drive sockets 312,314 at either end of the device and the intended use of the tool.

If, for example, it is desired to have a longer throw for each cycle of the augmentor 310, then the central portion of the tool between the drive sockets 312,314 can be widened as shown and discussed with respect to FIG. 13. This will provide a longer distance for the driven arms 330,336 to travel and therefore, increase the angle for each cycle.

Additionally, the size of the drive sockets can vary from less than an inch to more than 9 inches to accommodate nuts which fasten to studs of 6" or more in length.

Figure 12:
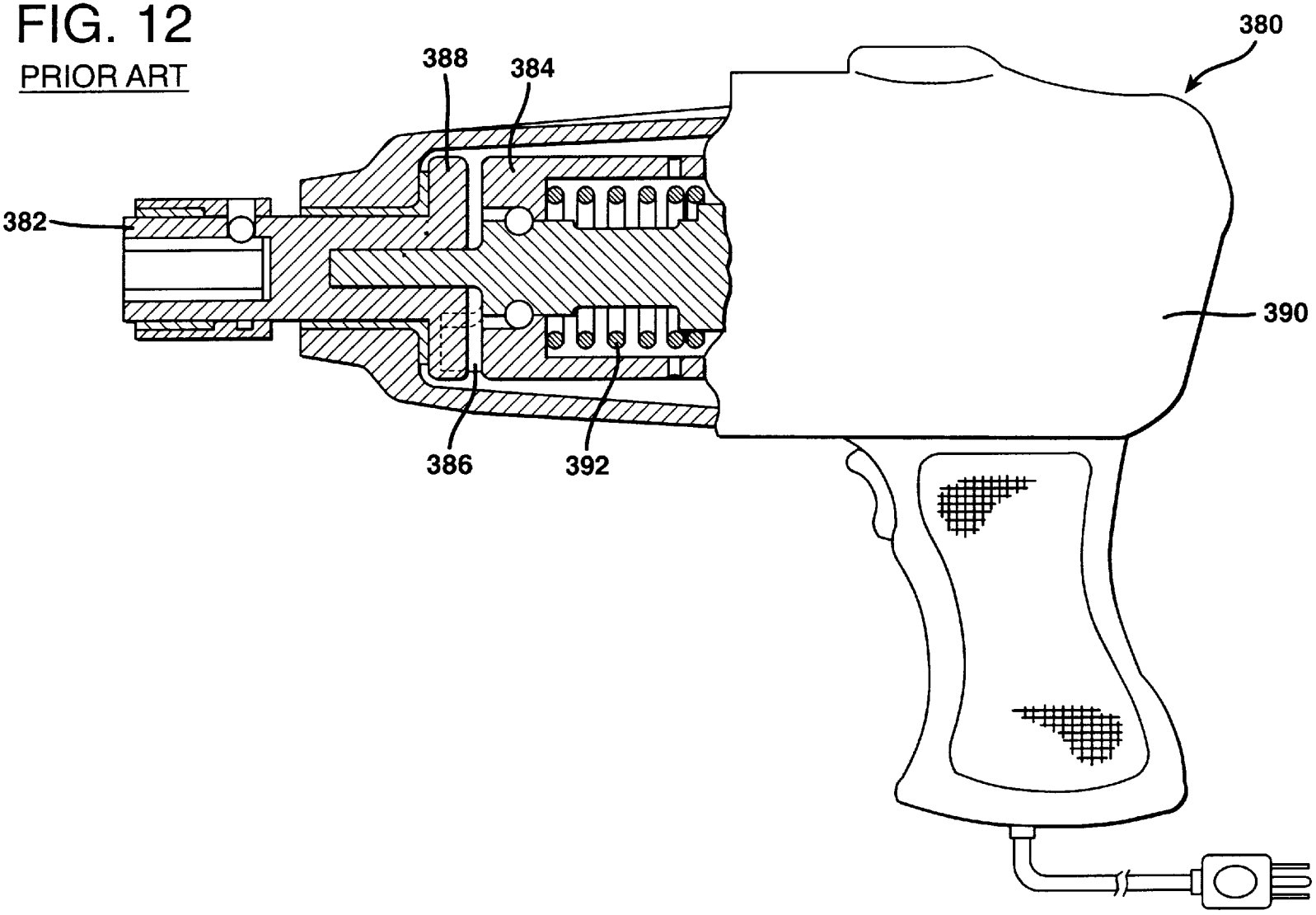
FIG. 12 PRIOR ART
FIG. 12 is a cross-sectional view of an impact wrench known in the art.

The system is well suited for use with external torquing devices, such as a commonly available impact wrench 380 shown in FIG. 12. This impact wrench 380 has a transmitting end 382 which is driven by a slide collar 384, that will oscillate back and forth, to engage and disengage the finger 386 extending from the collar to ride on camming surface 388 connected to the transmitting end 382. When the torque exerted by a motor 390 is sufficiently high to cause the torque level adjusting spring 392 to retract, the engaging finger 386 will ride up the cam surface 388 to a point such that the spring 392 is compressed sufficiently to enable the finger 386 to disengage from the camming surface 388 and allow the device to rotate internally without externally rotating the transmitting end of the device.

By inserting the transmitting end of the impact wrench into the driven socket 318 at the middle of the augmentor 310, the drive link 316 will rotate the drive fingers 344,346.

The housing halves 322,324 are joined together as shown in FIG. 9. A gasket 366 is interposed between the halves to seal a lubricant, such as grease for the elements, within the augmentor 310. The gasket can be formed by filling corresponding grooves in the mating surfaces of the housing with a substance that will cure to form a gasket.

There is a coaction between the internal spring of the impact wrench which causes the periodic application of torque, and the internal springs 348,350 connected to the link 316. The impact wrench produces an increase in torque and rotation until disengagement occurs between the drive finger and the camming surface. During movement of the impact wrench, the driven or middle link 316 of the augmentor 310 will move from the initial position as shown in FIG. 10 to a position at the opposite end of its travel against the other wall. When the spring of the impact wrench causes disengagement, the torque asserted is suddenly substantially reduced and the spring arrangement 348,350 of the augmentor will then cause the middle link 316 to rotate to the initial position shown in FIG. 10, bringing each one of the driven arms 330,336 up flush against a respective side of the inner wall 364 of the housing.

As the collar of the impact wrench 352 rotates in the direction of the arrows surrounding middle aperture 342, or in a counter-clockwise direction, the driven arm will rotate in the clockwise direction to rotate the driven socket 318 until the opposite side of the driven arm abuts the inner wall 364 of the housing.

To use the augmentor 310 to remove a fastener, the augmentor is turned over so that the angles are reversed and the direction of the impact wrench is also reversed.

As shown in FIGS. 9 and 10, the elements for the augmentor 310 are symmetrical about the central transverse axis 362. Regions A and B of the augmentor 310 at opposed sides of the axis 362 include elements which function in a symmetrical manner of operation. This provides for even torque augmentation during cycling and recycling, and relatively equal amounts of stress and wear upon the operable elements of the device.

FIG. 11 shows another embodiment of the augmentor invention shown generally at 410, in which a middle link 416 has two ears 466,468, which are used to connect compression springs 470,472, respectively, to the sidewall 464 of the housing. The compression springs 470,472 function in the same manner as the torsion springs 348,350 shown in FIG. 10, i.e. the function to position the middle link 416 to one extreme position to urge the driven arms 444,446 abutted against the wall 464.

FIG. 13 shows still another embodiment of the augmentor invention according to the present invention which is shown generally at 510. In this embodiment, a sidewall 568 of the augmentor 510 is bowed or widened at opposed sides shown generally at 570,572, with the apex of each widened portion occurring at approximately the transverse axis 562 of the housing for the augmentor 510. As with the embodiments in FIGS. 8–11, elements of this embodiment of the augmentor 510 are symmetrical at opposed sides of the axis 562.

The widening of the sidewall 568 of the housing provides for an increased throw of the central link 516 so that the respective driven arms 530,536 will proceed along the direction of the arrows 574,576, respectively, wherein the arms 530,536 abut a corresponding region of the sidewall 568. Because the arms 530,536 have to travel further for abutment with the sidewall 568, there is an increase in throw over that which is provided with the embodiments at FIGS. 8–11.

Accordingly, from the above description, the mechanical advantage that is imparted by means of the augmentor wrench can be varied depending upon the relative lengths of the driven arms and the drive fingers engaging the driven arms. An equal length of the driven arms in relation to the drive fingers will produce a neutral mechanical advantage. A positive mechanical advantage will result if the lever arm of the drive finger is longer than the lever arm of the driven arm and vice versa, if it is shorter. In the Figures, the drive finger is shown shorter than the driven arm thereby reducing the torque provided to the drive sockets below the torque provided to the middle driven socket.

The device of the present invention not only can act as an effective tool for manually tightening a fastener up to a certain extent, but the device offers significant advantages when working with an impact tool in confined spaces or spaces having relatively low clearance. The device is relatively narrow at the drive socket to fit over a bolt, or for a socket to be placed within the drive aperture to engage a nut. When the impact tool engaged with the augmentor relaxes, or there is a lull in the torque cycle, the internal springs of the augmentor will force the driven arm to the extreme initial position and the cycle will repeat itself. The combination of the impact tool and the augmenting wrench will continue to cycle until the torque necessary to rotate the driven arm is greater than the torque that is exerted by the impact wrench. In effect, the device dead ends when the pressure of the spring on the drive collar will be insufficient to rotate the driven arm of the augmentor.

The distance between the drive socket and the driven aperture affords clearance so that an impact tool such as shown in FIG. 12, can be applied to the augmentor at a substantial offset distance from the fastener acted upon.

A continuous gasket extends along the surface area of each one of the halves where the halves contact each other to form the housing. The elements described with respect to FIGS. 8–11 are bathed in grease to provide lubrication and cooling during the highly repetitious movement of the elements when being driven by the impact wrench.

The movement of the impact wrench in the drive receptacle causes each one of the sockets to move in an opposite direction in the ratio of the lever arms. That is, the sockets will rotate at the opposite ratio of the mechanical advantage.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. An augmenting wrench, comprising:

a housing;

torque input means accessible in the housing;

torque output means accessible in the housing, the torque output means adapted to engage an object to which torque will be applied; and linkage means within the housing connecting the torque input means with the torque output means, the linkage means slidably coacting with the torque input means to cause a first amount of torque introduced at the torque input means to produce a second amount of torque at the torque output means while the housing is stationary.

2. The augmenting wrench according to claim 1, further comprising:

resilient means disposed in the housing for coaction with the linkage means to resiliently urge the linkage means to an initial position after the linkage means has transferred an amount of torque.

3. The augmenting wrench according to claim 2, wherein the resilient means includes at least one compression spring.

4. The augmenting wrench according to claim 1, wherein the linkage means is constructed and arranged with respect to the housing to coact with the torque input means to enable repetitive rotation through angles of arc while the housing is stationary.

5. The augmenting wrench according to claim 1, wherein the linkage means comprises:

a driving arm operatively associated with the torque input means, a driving arm operatively associated with the torque output means, a link having a first end coacting with the driving arm and a second end coacting with the driven arm, means connecting the link with the driving arm and with the driven arm, the connecting means comprising:

pin means and slot means dipsosed on adjacent surfaces of said link correcting the driving and driven arms to effect sliding coaction between the link and the driving and driven arms.

6. The augmenting wrench according to claim 5, wherein the linkage means further comprises:

a pawl disposed at the driving arm for coaction with the torque input means.

7. The augmenting wrench according to claim 6, further comprising:

spring means operatively associated with the pawl to resiliently urge the pawl into coaction with the torque input means.

8. The augmenting wrench according to claim 1, further comprising:

a driven socket disposed at the torque input means;

a pair of driving sockets disposed at the torque output means;

the pair of driving sockets spaced apart at the housing at opposite sides of the driven socket of the torque input means;

wherein the driven socket and the pair of driving sockets are slidably interconnected by the linkage means.

9. The augmenting wrench according to claim 8, wherein the pair of driving sockets at the torque output means are symmetrically arranged in the housing.

10. The augmenting wrench according to claim 8, further comprising:

a first ratchet-pawl assembly operatively associated with the first driving socket; and a second ratchet-pawl assembly operatively associated with the second driving socket.

11. The augmenting wrench according to claim 8, wherein the linkage means comprises:

a single link interconnecting the driven socket with the pair of driving sockets.

12. A method of applying torque to a fastener, the method comprising the steps of:

engaging a drive socket within a wrench housing with a fastener to which torque is to be applied;

engaging a cycling torque applicating apparatus providing intermittent rotations with a driven aperture in the wrench;

cycling the torque applicating apparatus to rotate the driven aperture in the wrench; and rotating a linkage means in the wrench responsive to the cycling at the driven aperture to slidably coact with the drive socket apply torque to the fastener.

13. The method according to claim 1, further comprising the step of:

rotating the wrench through a plurality of repetitive turns using ratchet means in the wrench to coact with the drive socket.

14. The method according to claim 13, further comprising the step of:

rotating the drive socket through a plurality of repetitive turns without moving the housing for the wrench.

15. The method according to claim 12, further comprising the step of:

recycling the torque applicating apparatus to cause the linkage means to return to an initial position during a lull in the operation of the cycling torque applicating apparatus.

16. A wrench with torque augmenting means, comprising:

a housing having:

a first half with a first interior bottom surface extending to a first continuous side wall along the first half, a first drive input aperture extending through the first half, a first drive output aperture extending through the first half and separate from the first drive input aperture, a first pair of cutouts formed at opposed sides of the first continuous side wall of the first half, a second half with a second interior bottom surface extending to a second continuous side wall along the second half, a second drive input aperture extending through the second half, a second drive output aperture extending through the second half and separate from the second drive input aperture, a second pair of cutouts formed at opposed sides of the second continuous side wall of the second half, means to releasably engage the first half and second half with each other for the first pair of cutouts to be in registration with the second pair of cutouts to provide a pair of opposed spaces at opposite sides of the housing to part the housing, the first and second drive input apertures to be in registration with each other, and the first and second drive output apertures to be in registration with each other.

a first drive member having:

an oblong-shaped aperture extending through the first drive member, a first socket extending from the first drive member, separate and discrete from the oblong-shaped aperture, an exterior side wall conforming substantially to a portion of an interior surface of the first continuous side wall, the first socket constructed and arranged on the first member for registration with the first and second drive input apertures when the first and second halves are engaged;

a second driven member having:

a pin extending from the second driven member for coaction with the oblong-shaped aperture of the first drive member, the pin having a height at least equal to the depth of the oblong-shaped aperture, a second aperture extending through the second driven member separate and discrete from the pin, a second socket disposed in the second aperture, the second socket having:

a plurality of inclined teeth circumscribing the second socket forming a ratchet, a wear ring circumscribing the second socket and resting upon the plurality of inclined teeth of the second socket;

a recess formed in the second driven member;

a pawl disposed in the recess for movement therein, the pawl adapted to coact with the rachet;

a first pair of bores formed in the second member, each of the first pair of bores opening into the recess;

a second pair of bores formed in the pawl, each of the second pair of bores opening to face the recess for registration with the first pair of bores;

spring means disposed in said first and second pairs of bores to resiliently urge the pawl into coaction with the ratchet;

resilient means mounted in the housing for coaction with at least one of the first drive member and the second drive member to return said members to an initial position after the second driven member has pivoted to abut an interior wall of the housing; and rotation of the first socket coacting with the first drive member to impart motion to the second driven member to pivot for the pawl to engage the teeth of the ratchet at the second socket and rotate the second socket at the first and second drive outputs.

17. A wrench with torque augmenting means, comprising:

a housing;

torque input means accessible in the housing;

torque output means accessible in the housing and separate from the torque input means, the torque output means adapted to engage an object to be tightened; and means for coupling the torque input means with the torque output means for coaction therebetween, the coupling means disposed in the housing for coaction with the torque input means to transmit a first amount of torque introduced at the torque input means to a second amount of torque available at the torque output means; and resilient means adapted to coact with the coupling means to reset the coupling means to an initial position after a second amount of torque has been reached.

18. A wrench with torque augmenting means, comprising:

a housing having opposed sidewalls therein;

torque input means accessible in the housing;

torque output means accessible in the housing, the torque output means adapted to engage an object to which torque is to be applied;

means for connecting the torque input means with the torque output means for coaction therebetween, the connecting means disposed in the housing and adapted for movement toward the spaced sidewalls of the housing simultaneously to cause torque at the torque input means to be transferred to the torque output means; and resilient means adapted to coact with the connecting means to reset the connecting means to an initial position after reduction of torque at the torque input means.

19. An augmenting wrench, comprising:

a housing;

a driving socket in the housing;

a ratchet in the housing coacting with the driving socket;

a driven socket in the housing;

linkage means within the housing connecting the driving socket with the driven socket, the linkage means coacting with the ratchet and the driven socket to enable rotation of the driven socket to transfer torque to the driving socket while the housing is stationary; and resilient means disposed in the housing for coaction with the linkage means to resiliently urge the linkage means to an initial position after the linkage means has transferred an amount of torque, the resilient means including a spring, the spring connected to the housing and the linkage means.

20. An augmenting wrench, comprising:

a housing;

a driving socket in the housing;

a ratchet in the housing coacting with the driving socket;

a driven socket in the housing; and linkage means within the housing, the linkage means including:

a driving arm operatively associated with the driving socket, a driven arm operatively associated with the driven socket, a link having a first end coating with the driving arm, and a second end coacting with the driven arm;

means connecting the link with the driving arm and with the driven arm, the connecting means comprising:

pin means and slot means disposed on adjacent surfaces of said link connecting the driving and driven arms to effect sliding coaction between the link and the driving and driven arms;

a pawl disposed in the housing for coaction with the ratchet of the driving socket;

wherein the ratio of the relative lengths of the driving linkage to the driven linkage determines the torque applied between the driving socket and the driven socket.

21. A method of applying torque to a fastener, the method comprising the steps of:

engaging a drive socket of a wrench with a fastener to which torque is to be applied;

engaging a cycling torque applicating apparatus with a driven aperture in the wrench;

cycling the torque applicating apparatus to rotate the driven aperture in the wrench;

rotating a linkage means in the wrench responsive to the cycling at the driven aperture to coact with the drive socket to apply torque to the fastener; and recycling the torque applicating apparatus to cause the linkage means to return to an initial position for further cycling the torque applicating apparatus.

* * * * *